United States Patent [19]

Simpson

[11] 4,295,409

[45] Oct. 20, 1981

[54] SHOT AND POWDER DISPENSER ATTACHMENT

[76] Inventor: Frank H. Simpson, Rte. 2 Box 276, Cornelius, Oreg. 97113

[21] Appl. No.: 31,764

[22] Filed: Apr. 20, 1979

[51] Int. Cl.[3] ..... F42B 33/02

[52] U.S. Cl. ..... 86/31; 86/29; 222/137; 222/144.5; 222/305

[58] Field of Search ..... 222/305, 137, 144.5, 222/162, 185; 86/24, 25, 28, 29, 30, 31, 33

[56] References Cited

U.S. PATENT DOCUMENTS

| | | | |
|---|---|---|---|
| 268,665 | 12/1882 | Hartwell | 222/162 X |
| 2,670,878 | 3/1954 | Curry | 222/137 |
| 3,105,408 | 10/1963 | Bachhuber | 86/25 |
| 3,157,086 | 11/1964 | Bachhuber | 86/31 X |
| 3,361,024 | 1/1968 | Sherrill | 86/31 X |
| 3,450,000 | 6/1969 | Ponsness | 86/25 |
| 3,604,057 | 9/1971 | Nixdorff | 222/137 X |
| 3,771,411 | 11/1973 | Hazel | 86/25 X |

*Primary Examiner*—F. J. Bartuska
*Attorney, Agent, or Firm*—Francis Swanson

[57] ABSTRACT

An attachment for dispensing shot and powder in conjunction with a shell reloading tool is disclosed. The invention is intended for use with those types of reloading machines which sequentially dispense shot and powder into a number of shells being progressively reloaded on the work table of the reloading machine. The device includes a frame mounted on the reloading machine and has a series of pivotable members which carry the shot and powder bottles. A sliding bar operatively connected to the actuating mechanism of the loading machine dispenses the shot and powder into the shells being reloaded at the appropriate time. The sliding bar includes a series of removable bushings which permit rapid change over to the dispensing of different amounts of powder and shot.

2 Claims, 5 Drawing Figures

SHOT AND POWDER DISPENSER ATTACHMENT

BACKGROUND OF THE INVENTION

1. Field of the Invention

The invention pertains to powder and shot dispensing attachments for loading machines generally and more particularly to those intended for use with rotary loading machines capable of reloading several shells progressively.

2. Description of the Prior Art

Numerous devices for dispensing shot and powder in conjunction with a reloading tool exist in the prior art. A typical example is shown in U.S. Pat. No. 3,450,000 to Ponsness. Another is illustrated in U.S. Pat. No. 3,771,411 to Hazel. Another is shown in U.S. Pat. No. 3,105,408 to Bachhuber. While all these references disclose means for metering powder and shot to cartridges being loaded, none discloses a means for rapidly changing the amount of powder and shot dispensed, so that a single loading machine can be used to load a wide variety of shell sizes. The present invention overcomes these deficiencies by providing removable bushings within the dispenser together with pivotable mountings for the shot and powder bottles.

SUMMARY OF THE INVENTION

It is a principal object of the invention to provide a shot and powder dispensing attachment which can be rapidly adapted to meter different amounts of shot and powder to cartridges being reloaded.

A further object of the invention is to provide means for stopping the flow of powder and shot without removal of the bottles from the dispenser.

A further object of the invention is to provide pivotable carriers for the shot and powder bottles, the carriers pivotable to three positions.

Other objects and advantages of the invention will be apparent to those skilled in the art with reference to the accompanying drawings and specification.

DETAILED DESCRIPTION

Figure 1:
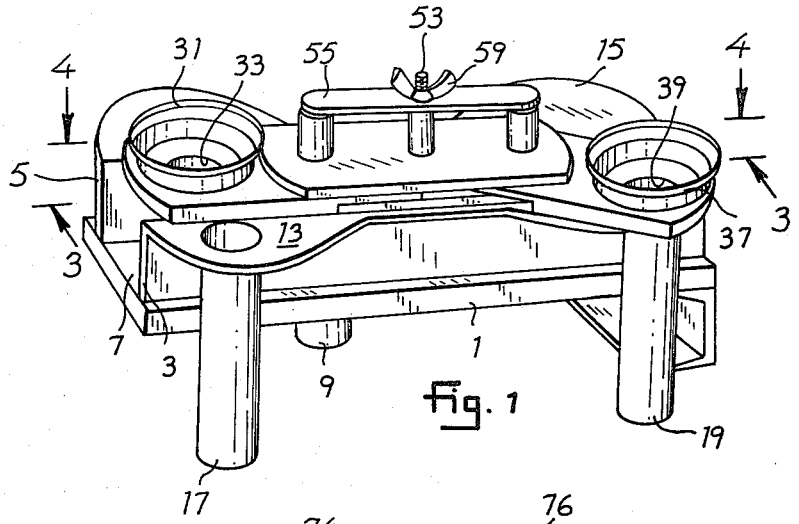
FIG. 1 is a perspective view of the dispenser with the metering bar removed.

Referring now to FIG. 1, the dispenser comprises a body including a base 1 upon which is operatively connected a first side member 3 and a second side member 5. Members 3 and 5 together with base 1 define a channel 7. Downwardly depending from base 1 are dispensing tubes 9 and 11 and connect to channel 7. On first side member 3 is a curved lip 13. On second side member is a curved lip 15. On lip 13 is mounted a pair of tubular chutes 17 and 19. Operatively connected to base 1 is a bracket 21.

Above channel 7 and operatively connected to side members 3 and 5 is a top plate 23 which defines a pair of threaded bosses 25. Screws 27 are removably threaded into bosses 25. Pivotably connected to top plate 23 about bosses 25 are a first carrier plate 29 and a second carrier plate 35. Plate 29 has mounted thereon a threaded seat 31 which defines a passageway 33. Second carrier plate 35 also has mounted thereon a threaded seat 37 which defines a passageway 39. Operatively connected to top plate 23 is a detente plate 41. Upon plate 41 are a pair of cylindrical stubs 43 each of which is hollow and defines a bore 45. The upper end of stubs 43 each define a hole 47. Within the bore 45 of stub 43 is mounted a ball 49 which is loaded by a spring 51. Detente plate 41 further defines an upperwardly directed shaft 53. Upon shaft 53 is mounted a clamping plate 55 which defines a pair of shafts 57 which when in place fit through holes 47 of detente plate 41 and bear against ball 49 within bore 45. Plate 55 is held in place by a wing nut 59 and bears against a cylindrical spacer 61 which surrounds threaded shaft 53. Seats 31 and 37 carry bottles 63 and 65. Bottle 63 is powder. Bottle 65 is shot. Carrier plates 29 and 35 can be individually pivoted to a first position over curved lip 15, stopping the flow of powder and shot. A second position places bottles 63 and 65 over channel 7. The third position places carriers 29 and 35 over chutes 17 and 19 for emptying.

Figure 2:
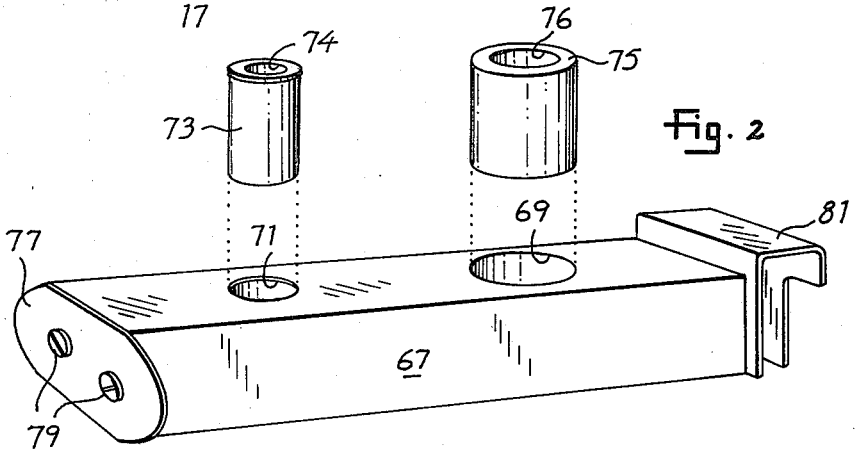
FIG. 2 is a perspective view of the metering bar illustrating the relation of the removable bushings.
Figure 3:
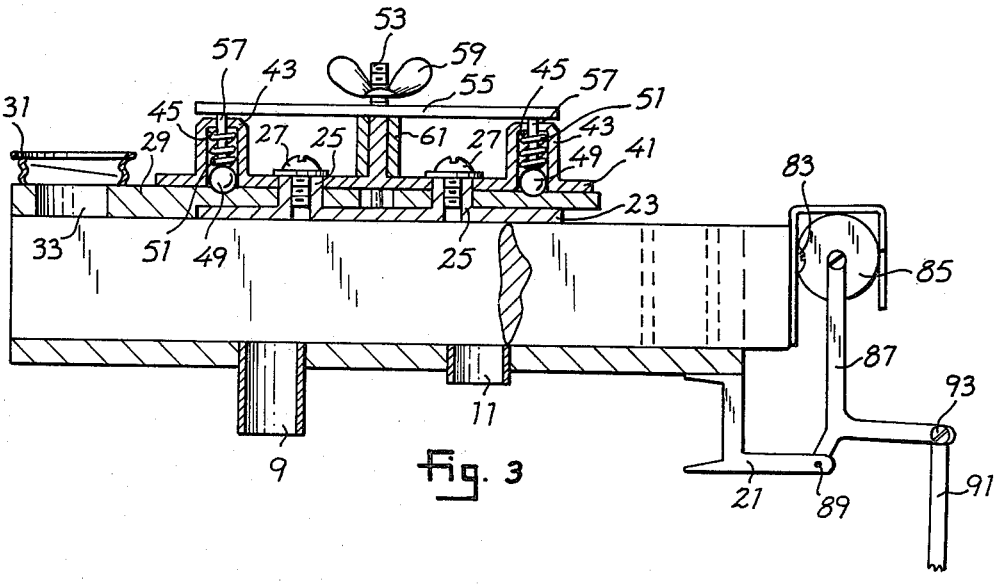
FIG. 3 is a sectional view taken along line 3—3 of FIG. 1.
Figure 4:
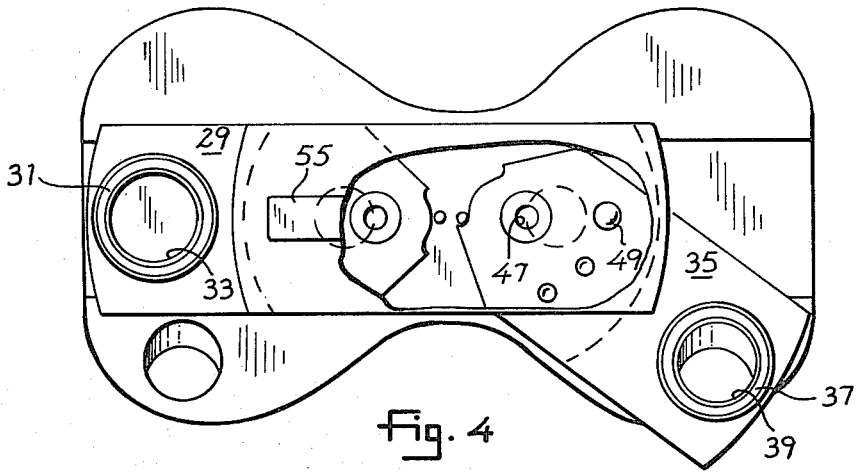
FIG. 4 is a plan view of the invention partially broken away to illustrate internal construction.

Within channel 7 is a sliding bar 67, as illustrated by FIG. 2. Bar 67 defines two bores 69 and 71 into which slip metering bushings 73 and 75 respectively. Bushing 73 defines a cavity 74 and bushing 75 defines a cavity 76. A stop plate 77 is attached to one end of bar 67 by screws 79. On the other end of bar 67 is a generally U shaped bracket 81 secured by screws 83. A roller 85 fits into bracket 81. Roller 85 is pivotably mounted on carrier 87. Carrier 87 is pivotably mounted on bracket 21 by pin 89. A rod 91 is pivotably attached to carrier 87 with bolt 93. Rod 91 is operatively connected to the actuating handle 95 of the reloading machine.

OPERATION

Figure 5:
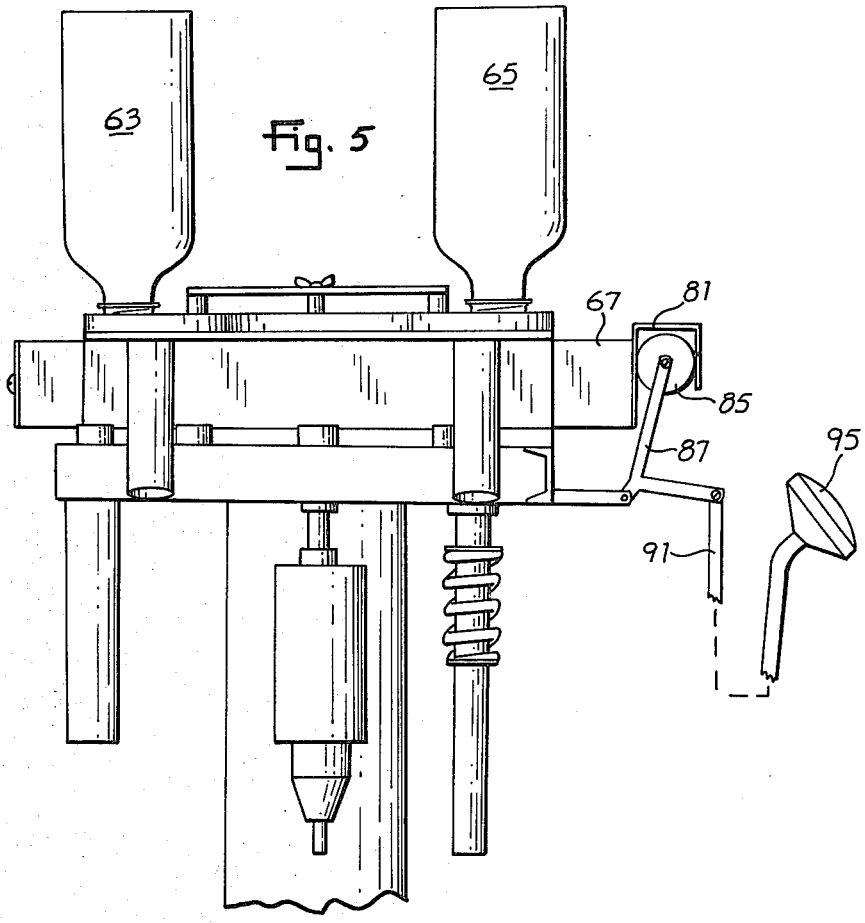
FIG. 5 is a side elevation of the invention showing how the invention mounts on a typical sequential loading machine.

Assume now that the dispenser is in place on a suitable loading machine as illustrated in FIG. 5 and sliding bar 67 is moved all the way to the left in channel 7. As the operator actuates handle 95, rod 91 moves downward and acts on carrier 87 causing it to pivot clockwise about pin 89. Roller 85, moving inside bracket 81, will exert a force against sliding bar 67 and the bar will move to the right through channel 7. As bushing 75 is aligned with passageway 33, powder from bottle 63 will fill the cavity 76 within 75. As sliding bar moves progressively to the right along channel 7, bushing 75 will line up with dispensing tube 9. The powder within cavity 76 is then metered through tube 9 to the shell to be loaded by the reloading machine.

As sliding bar 67 moves further to the right along channel 7, metering bushing 73 comes into alignment with passageway 39 and shot from bottle 65 fills cavity 74 within bushing 73. The operator now moves the handle 95 in the opposite direction. This causes rod 91 to move upward against carrier 87. This will cause carrier 87 to pivot counter clockwise about pin 89. Roller 85, moving in bracket 81, forces the bar 67 to slide leftward in channel 7 until bushing 73 becomes aligned with dispensing tube 11. The shot from within cavity 74 of bushing 73 is then dispensed through tube 11 into the shell being reloaded, and to which powder has previously been added. This leftward movement also carries bushing 75 back into position to receive powder from bottle 63 through passageway 33. To begin the next dispensing sequence, the operator again moves handle 95 so as to cause bar 67 to slide to the right, as previously described.

To change bushings, it is only necessary to pivot first and second carrier plates 29 and 35 about bosses 25, from their positions above sliding bar 67, into alignment with tubular chutes 17 and 19 on lip 13 or to the flow blocking position on lip 15″.

The bar may then be moved progressively along channel 7 until metering bushings 73 and 75 are exposed. Since these bushings are mounted in sliding bar 67 merely as a slip fit, removal can be readily effected by hand without the aid of any tools. New bushings of the proper size may then be inserted into bar 67 and the bar moved back to its starting position in the loading sequence. Carrier plate 29 and 35 are then moved back into position above channel 7 and the loading sequence may begin again. It is readily seen that either plate 29 or plate 35 may be pivoted outward by itself and only the corresponding bushing changed. This allows the operator to use the same type of powder but change shot size or to use the same shot size and use a different type of powder merely by changing metering bushings 73 or 75.

While the preferred embodiment of my invention has been disclosed and has been described in detail, it will be readily apparent to those skilled in the art that many modifications thereof could be made without departing from the true spirit and scope of the invention. I claim all such modifications as follow in the true spirit and scope of the appended claims.

I claim:

1. A shot and powder dispenser in combination with a cartridge reloading machine comprising:

a body defining a channel;

metering means movable within the channel;

lip means on the body, the lip means including a hollow chute;

a powder carrier on the body, the carrier optionally pivotable;

from a first position above the metering means to either a second position on the lip means, so that the flow of powder to the metering means is blocked, or to a third position on the lip means above the chute;

and a dispensing tube on the body operatively connected to the metering means and to the reloading machine.

2. A shot and powder dispenser in combination with a cartridge reloading machine comprising:

a body defining a channel a movable bar within the channel;

a plurality of removable metering bushings on the bar, each bushing defining a hollow cavity within the bar;

a first lip on the body;

a second lip up on the body, the second lip including a chute;

a powder carrier on the body, the powder carrier optionally pivotable out of communication with the movable bar to either a first position above the first lip or a second position above the chute;

a shot carrier on the body, the shot carrier pivotable into and out of communication with the movable bar;

a powder carrying tube on the body interposed between the bar and the reloading machine;

and a shot carrying tube on the body interposed between the bar and the reloading machine.

* * * * *